US006604507B1

(12) United States Patent
Lei et al.

(10) Patent No.: US 6,604,507 B1
(45) Date of Patent: Aug. 12, 2003

(54) FUEL INJECTOR

(75) Inventors: Ning Lei, Addison, IL (US); Xilin Yang, Elk Grove Village, IL (US); Steven C. Arnold, Lombard, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 09/392,814

(22) Filed: Sep. 9, 1999

Related U.S. Application Data

(60) Provisional application No. 60/099,818, filed on Sep. 10, 1998.

(51) Int. Cl.[7] ..... F02M 37/04

(52) U.S. Cl. ..... 123/446; 123/300; 123/496

(58) Field of Search ..... 123/446, 500, 123/501, 299, 300, 467, 496

(56) References Cited

U.S. PATENT DOCUMENTS

| | | | | |
|---|---|---|---|---|
| 2,985,378 A | | 5/1961 | Falberg | |
| 4,182,492 A | | 1/1980 | Albert et al. | |
| 4,838,232 A | | 6/1989 | Wich | |
| 5,325,834 A | * | 7/1994 | Ballheimer et al. | 123/446 |
| 5,326,034 A | * | 7/1994 | Peters | 239/90 |
| 5,341,783 A | * | 8/1994 | Beck et al. | 123/446 |
| 5,413,076 A | * | 5/1995 | Koenigswieser et al. | 123/446 |
| 5,423,484 A | | 6/1995 | Zuo | |
| 5,460,329 A | | 10/1995 | Sturman | |
| 5,487,508 A | | 1/1996 | Zuo | |
| 5,492,098 A | | 2/1996 | Hafner et al. | |
| 5,505,384 A | | 4/1996 | Camplin | |
| 5,517,972 A | | 5/1996 | Stockner | |
| 5,529,042 A | | 6/1996 | Augustin et al. | |
| 5,558,067 A | * | 9/1996 | Blizard et al. | 123/501 |
| 5,709,194 A | | 1/1998 | Moncelle | |
| 5,711,279 A | | 1/1998 | Green et al. | |
| 5,720,261 A | | 2/1998 | Sturman et al. | |
| 5,730,104 A | * | 3/1998 | Hafner | 123/446 |
| 5,826,561 A | | 10/1998 | Mack et al. | |
| 5,865,156 A | * | 2/1999 | Feucht et al. | 123/446 |
| 6,012,429 A | * | 1/2000 | Beatty et al. | 123/446 |

FOREIGN PATENT DOCUMENTS

| | | |
|---|---|---|
| EP | 0691471 | 10/1996 |
| GB | 2132704 | 11/1984 |

OTHER PUBLICATIONS

C.Cole, O.E.Sturman, D.Giordano, SAE Paper No. 1999–01–0196, Application of Digital Valve Technology to Diesel Fuel Injection pp. 1 to 7, Jan., 1999.

Mike Osenga, CAT Gears Up Next Generation Fuel Systems, Diesel Progress, Aug. 1998, pp. 82 to 90, North American Edition.

* cited by examiner

*Primary Examiner*—Carl S. Miller
(74) *Attorney, Agent, or Firm*—Dennis Kelly Sullivan; Susan L. Lukasik; Jeffrey P. Calfa

(57) ABSTRACT

A fuel injector includes a spool control valve, a plunger which moves in a fuel pressure chamber between retracted and full stroke positions. The fuel injector may include a spill port for spilling fuel from the fuel pressure chamber, the spill port being open at the start and closed by the translating motion of the plunger to delay the start of injection. The fuel injector chamber may further include a control port which is closed at the start of plunger motion and is opened by the plunger to connect the pressure chamber to a needle back chamber to bias the needle valve closed. The needle back chamber becomes isolated from the pressure chamber by further movement of the plunger and includes a pressure control passage to allow the pressure therein to decay upon control port closure, thereby effecting split injection or rate shaping.

87 Claims, 7 Drawing Sheets

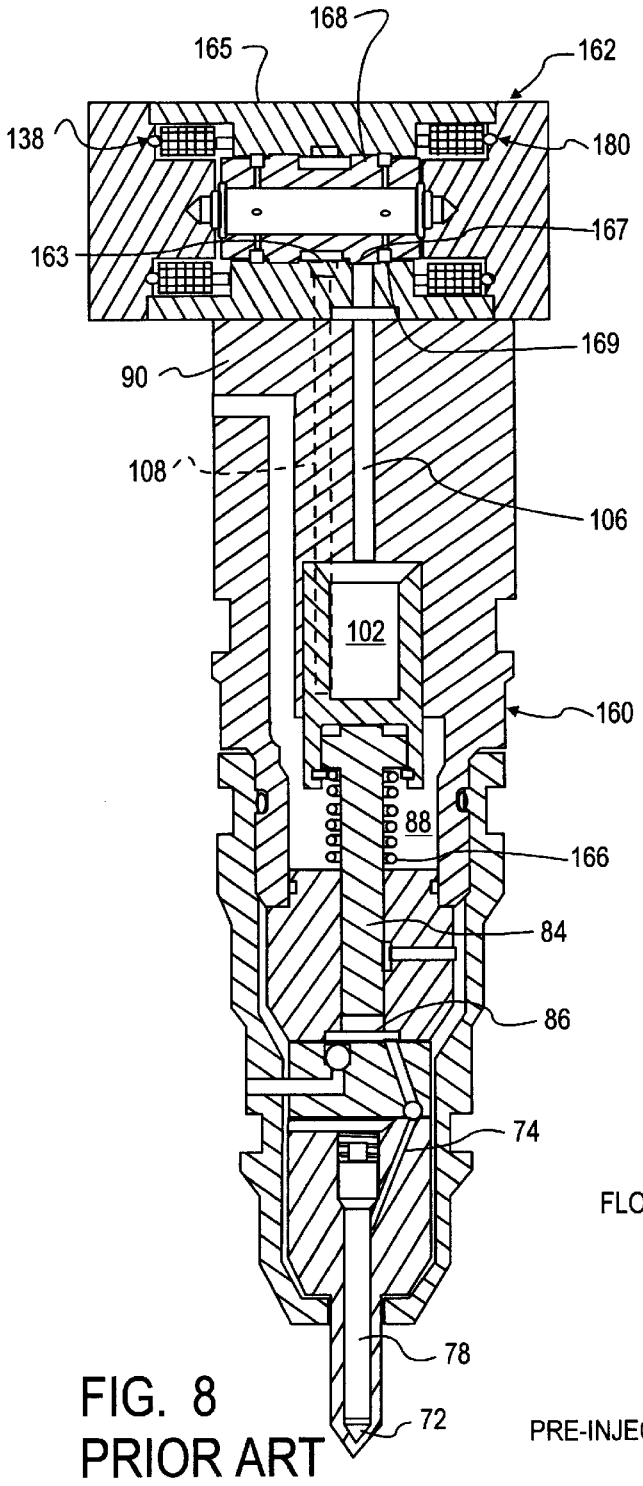
FIG. 8
PRIOR ART
FIG. 9
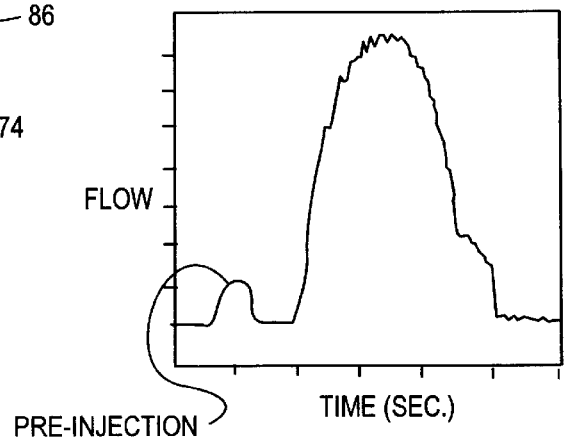

FUEL INJECTOR

PRIORITY

This application claims the benefit of U.S. Provisional Application No. 60/099,818, filed Sep. 10, 1998, which is incorporated herein in its entirety by reference.

TECHNICAL FIELD

The present invention relates to a fuel injector for use within an internal combustion engine. More particularly, the present invention relates to control of an injection event of a fuel injector by means of spill and/or bypass techniques.

BACKGROUND OF THE INVENTION

A fuel injector, particularly a fuel injector for use with a diesel engine, is required to very accurately discharge a quantity of fuel into a combustion chamber of an internal combustion engine over a wide range of engine operating conditions. The discharge of fuel typically occurs during a certain crank angle, such as, for example, 30 degrees, regardless of engine rotational speed.

While certain aspects of the invention described herein may be utilized with a number of different types of fuel injectors, including (HEUI) and mechanically-actuated, electronically-controlled unit injectors (MEUI) injectors of the types disclosed in the article, "Cat Gears up Next Generation Fuel Systems," *Diesel Power,* August 1998, aspects of the invention are particularly suitable for use with a hydraulically-actuated fuel injector having a spool type control valve of the type disclosed in U.S. Pat. No. 5,460, 329 ("the '329 patent"), and in Society of Automobile Engineers paper No. 1999-01-0196 entitled "*Application of Digital Valve Technology to Diesel Fuel Injection*".

FIG. 8 shows an exemplary prior art injector 160 controlled by a three-way spool control valve 162. In this embodiment, an actuating fluid supply passage 108 in the injector body 90 is connected to a supply groove 163 in the control valve housing 165 and a working passage 106 connects an intensifier chamber 102 to a working groove 167 in the control valve housing 165. The control valve housing further has a drain groove 169 to vent the actuating fluid from the injector. Movement of the spool 168 provides fluid communication between the working passage 106 and either the supply passage 108 or the drain 169.

When the spool 168 connects the working passage 106 with the supply passage 108, the pressure within the intensifier chamber 102 pushes the intensifier plunger 84 to pressurize fuel in the pressure chamber 86. The pressurized fuel travels through passage 74 to the needle valve 72 and lifts the valve needle 78 so that fuel is ejected from the injector 160. When the spool 168 connects the working passage 106 with the drain 169, the force of the spring 166 moves the intensifier plunger 84 back to the original position while the fluid within the intensifier chamber 102 flows through the drain 169.

The purpose of the control valve 162 in a hydraulically intensified fuel injector is to control the timing and flow of the hydraulic working fluid to the intensifier chamber 102. The control valve 162 has only three different components: the spool 168, the housing 165, and two identical electromagnetic coils 138 and 180. Beginning in the closed position, when the open coil 138 is energized by a voltage, the magnetic force generated causes the spool 168 to translate leftward towards the open coil 138 to connect the supply passage 108 to the working passage 106. Once the spool 168 stops at the hard limit which is part of the coil assembly 138, the voltage is discontinued. However, actuating fluid flow continues due to the spool position.

To end the fluid flow, the close coil 180 is energized by a voltage. The magnetic force generated by the close coil 180 causes the spool 168 to translate rightward towards the close coil 180 connecting the working passage 106 to the drain 169.

Shifting the spool 168 of the control valve 162 from the closed position to the open position and a return shifting to the closed position is a round trip for the spool 168. The minimum round trip time is the minimum time it takes for a complete round trip. Less than a complete round trip puts the control valve 162 in a region of unstable operation as will be further described below.

It may be desirable during a single injection cycle to provide for a relatively small pre-injection flow of fuel prior to the main injection event. The resulting injection flow profile is termed rate shaping or split pilot injection depending on whether one injection (rate shaping) or two injections (pilot injection) occur during the injection event. However, if the control valve does not make a complete round trip between the closed position and the open position and back to the closed position during the injection event, for example, if the control valve is retracted to the closed position before arriving at the open position, the fuel delivery commanded by such partial movement of the spool of the control valve is unstable and undesirable.

Accordingly, there is a need in the industry to eliminate the instabilities resulting from a partial translation of the spool of the control valve from the closed position toward the open position before retraction to the closed position.

Further, there is a need in the industry to continually improve the precise control of pilot injection and rate shaping to enhance the performance and emissions characteristics of engines utilizing fuel injectors.

An important consideration of a diesel fuel injector is its capability of delivering a small pilot injection of fuel (as small as 1 $mm^3$) prior to the main injection event and its capability of controlling the shape of fuel delivery curve. Both have proved to be very difficult to achieve because of the following reasons:

For engine emission optimization, a very high-injection pressure is desired; therefore, the needle valve is subjected to a very high fuel pressure and it is easy to reach the needle valve full lift (full open) position when fuel is pressurized under the intensifier plunger 14. However, for a small quantity of fuel delivery, the full lift position is not desirable since, at this position, the nozzle is full open and the controllability of the small quantity of fuel is accordingly very poor.

The position of the needle valve controls the opening area of injection nozzle orifice. For a small quantity of fuel delivery at high operating pressure, a very small needle valve lift, which only opens the nozzle orifice very slightly, is desired. This small lift is only needed during the pilot or rate shaping operation period when very small injection quantities are desired. For the main injection event, the needle valve should be able to reach its full lift position without any negative effect. Because of this, the controllability of the needle valve position during pilot or rate shaping operation becomes very important and also very difficult.

SUMMARY OF THE INVENTION

Various aspects of the invention described herein are intended to meet the aforementioned needs of the industry.

One embodiment of the invention provides for a charge of pressurized fuel to the needle valve or check only when enough time has elapsed for the spool valve to make a round trip from the closed position to the open position and back to the closed position. A fuel injector of the such embodiment includes an intensifier, the intensifier having a plunger translatable in a cylinder between a retracted position and a full stroke position, the cylinder being defined by a cylinder wall, the cylinder wall defining in part a variable volume fuel pressure intensification chamber. The fuel injector further includes a spill port intersecting the cylinder wall, the spill port being open at the beginning of the injection event and closed by the intensifier plunger during the translating motion of the intensifier plunger for spilling fuel from the variable volume intensification chamber as desired. The present embodiment further includes a method of delaying the beginning of an injection event.

The present invention additionally is a fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, wherein the fuel injector includes a spool valve being shiftable between a closed position and an open position, the spool valve motion having at least one round trip during an injection between the closed position and the open position and a return motion toward the closed position. A spill port intersects the cylinder wall, the spill port being open at the beginning of an injection cycle and closed by the intensifier plunger during the translating motion of the intensifier plunger for spilling fuel from the variable volume intensifier pressure chamber as desired.

An second embodiment of the invention provides for spilling the fuel from the fuel intensifier chamber to maintain the needle valve in a closed position at the beginning of injection and slowing the initial lift of the needle during the injection to provide delaying the beginning of the injection event and for rate shaping or split injection once the injection event has begun.

A fuel injector of the second embodiment includes an intensifier, the intensifier having a plunger translatable in a cylinder between a retracted position and a full stroke position, the cylinder being defined by a cylinder wall, the cylinder wall defining in part a variable volume fuel pressure intensification chamber. The fuel injector further includes a spill port intersecting the cylinder wall, the spill port being open at the beginning of the injection event and closed by the intensifier plunger during the translating motion of the intensifier plunger, for spilling fuel from the variable volume intensification chamber to a needle back chamber in a manner biasing the needle valve to a closed position, the needle back chamber including a pressure control passage to allow the pressure in the needle back chamber to decay upon the spill port being closed. The present embodiment further includes a method of delaying the beginning of an injection event and providing for rate shaping and split injection.

A third embodiment of the invention provides for rate-shaping or split injection to close or partially close the needle valve during an injection event by providing passive control of the needle.

A fuel injector of third embodiment includes an intensifier, the intensifier having a plunger translatable in a cylinder between a retracted position and a full stroke position, the cylinder being defined by a cylinder wall, the cylinder wall defining in part a variable volume fuel pressure intensification chamber. The fuel injector further includes a control port in the cylinder which is initially closed at the start of motion by the intensifier plunger and is opened by movement of the plunger to connect the fuel intensification chamber to a needle back chamber in a manner forcing the needle valve to be moved toward closure. The needle back chamber becomes isolated from the fuel intensification chamber upon further movement of the plunger to close the control port while the needle back chamber includes a pressure control passage to allow the pressure in the needle back chamber to decay upon the control port being closed. Such another embodiment further includes a method of providing rate shaping and or split injection.

The invention further includes a fourth embodiment which combines of the foregoing delay and rate shaping functions by providing both a spill port and a control port wherein both the spill port and the control port are connected to the needle back chamber.

Other objects and advantages of the invention are discussed below or will become apparent upon the perusal of the Detailed Description of the various embodiments and a review of the drawings.

BRIEF DESCRIPTION OF THE DRAWINGS

FIG. 8 is a cross-sectional view of a prior art fuel injector; and

FIG. 9 is a graph showing the ideal and actual fuel injection curves for a fuel injector.

DETAILED DESCRIPTION OF THE PREFERRED EMBODIMENTS

In the performance specification for any injector, there is a minimum deliverable quantity of fuel that is called the minimum fuel delivery capability. This minimum quantity is used to indicate the control precision, operation smoothness, and performance variability, etc. of the injector. Especially for an injector with pilot operation capability, this minimum quantity is a key feature of injector technology for engine emission and noise level control. To achieve a controllable minimum fuel delivery capability, a relatively short pulse width is given to the control valve to force the control valve open to its full travel position and then return immediately to its closed position. This is called the minimum round trip of the control valve. The control valve has to have full travel from stop to stop to ensure its motion repeatability and controllability. This is true for virtually all control valves. Without a hard stop (e.g., against a wall), any partial motion (less than a full round trip) causes significant injector-to-injector and event-to-event variability in fuel delivered. Therefore, it is a non-repeatable and uncontrollable region of control valve operation. It is a common object among injector manufacturers and end users that all of fuel deliveries occurring under partial control valve motion should be eliminated to avoid variability. With the elimination of partial motion, the minimum fuel delivery quantity then increases to a higher level as illustrated by the knee location (point 3 in FIG. 1) and curve 3 in FIG. 2. This number is significantly higher than 1 $mm^3$/stroke, 1 $mm^3$ being a normally targeted specification.

The minimum quantity of fuel delivery is controlled by how fast the control valve can finish a complete round trip motion (stop to stop to stop) at given oil rail pressure (fastest round trip or minimum round trip). The control valve may not be fast enough to complete a minimum round trip without increasing fuel pressure in the pressure chamber enough to cause injection. A significant amount of fuel could be introduced to the combustion cylinder under minimum round trip motion of a control valve especially at high oil rail pressure. It is true for most injection systems (both intensifier system and direct needle control system), that injection already starts during control valve partial motion, an undesirable condition.

Figure 1:
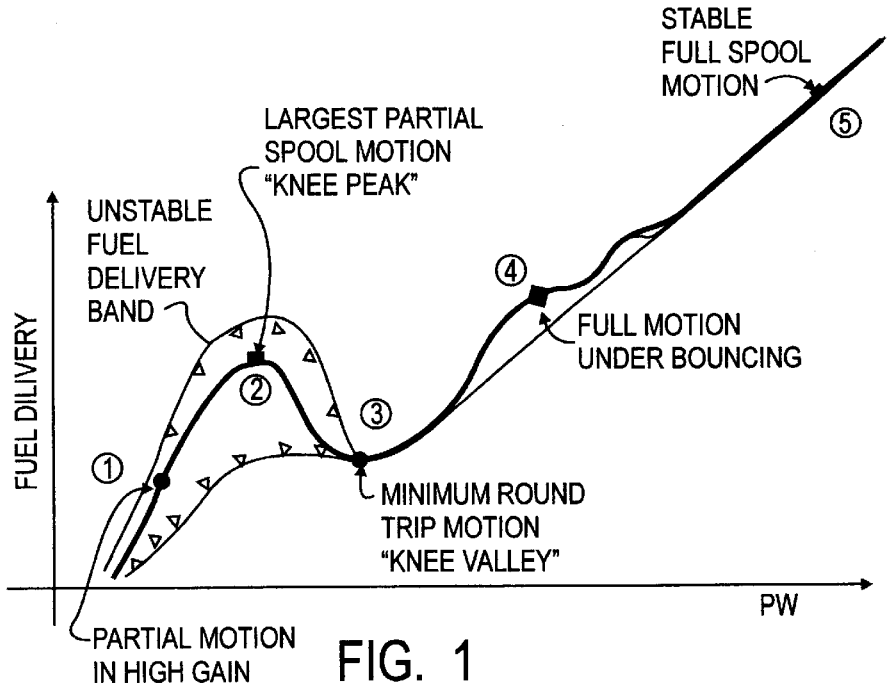
FIG. 1 is a graph of fuel delivery from the fuel injector nozzle valve corresponding to spool motion.
Figure 2:
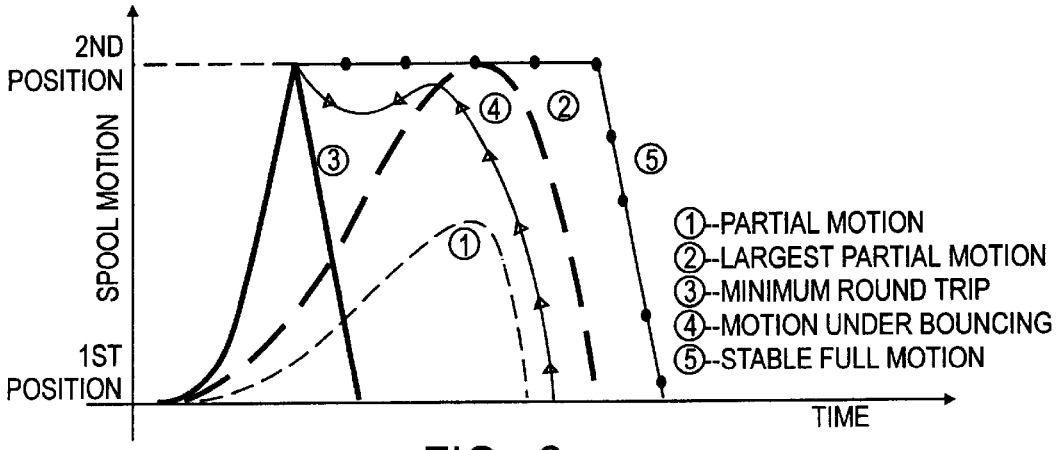
FIG. 2 is a graph of spool motion with respect to time where the various curves presented correspond to the numbered points on the graph of FIG. 1.

Consequently, one object of the present invention is to correct for certain instabilities that may occur in the fuel delivery as a result of partial motion of the spool type control valve of the injector shown in FIG. 8. The partial motion of the spool valve is defined as the spool valve translating away from the closed position toward the open position and being recalled to the closed position prior to completing a round trip as discussed above. Referring to FIG. 2, the first trace 1 depicts this partial motion. In trace 1, the spool valve leaves the closed position, translating toward the open position, gets approximately half the distance to the open position then is recalled to the closed position. Referring to trace 12 of FIG. 1, the fuel delivery at point 1 thereon corresponds to the aforementioned partial motion. A problem with such partial motion is that the fuel delivery is unstable and can be anywhere within a relatively wide band of fuel delivery as shown by the upper and lower band curves. In order to achieve a desired pilot or pre-injection, such as shown in FIG. 9, a very precisely controlled amount of fuel is required. The instability of the fuel delivery that is apparent at point 1 of trace 12 is not consistent with providing for the desired pilot injection.

Trace 2 of FIG. 2 depicts the largest partial motion that occurs. In trace 2, the spool valve direction of travel is reversed immediately prior to achieving disposition in the open position. The instabilities in fuel delivery are apparent in FIG. 1 at point 2.

Trace 3 of FIG. 2 is the minimum round trip motion of the spool valve. In trace 3 of FIG. 2, the spool valve translates from the closed position to the open position and is immediately retracted to the closed position. As indicated in FIG. 1, the minimum round trip of trace 3 is the first position on trace 12 which there is stable and predictable fuel delivery at result of full travel spool motion.

Trace 4 of FIG. 2 rises coincident with the leading portion of trace 3 but then proceeds through a bouncing motion in the return of the spool valve from the open position to the closed position. This bouncing motion produces some non-linearities in the fuel delivery as indicated at point 4 on trace 12 of FIG. 1.

Trace 5 of FIG. 2 represents stable full motion of the spool. Trace 5 rises coincident with the first portion of the minimum round trip 3 between the closed position and the open position. The spool remains in the open position for a selected period of time, as indicated by the generally horizontal portion of trace 5, and then returns in a generally linearly translation from the open position to the closed position.

Figure 3:
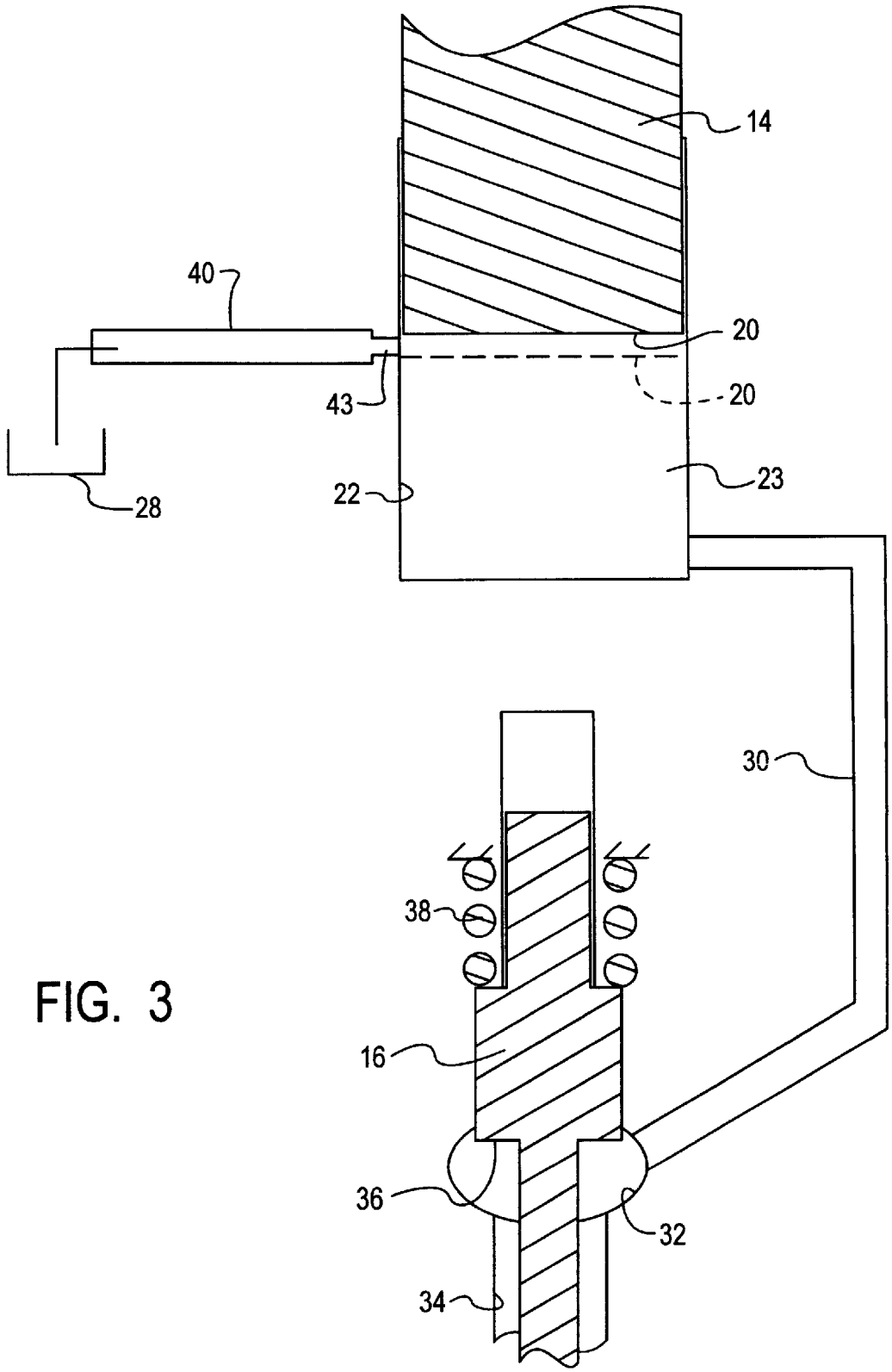
FIG. 3 is a schematic diagram of a first embodiment of the invention illustrating the fuel pressure intensification portion of a fuel injector having a direct spill passageway and a fuel injector needle valve.
Figure 7:
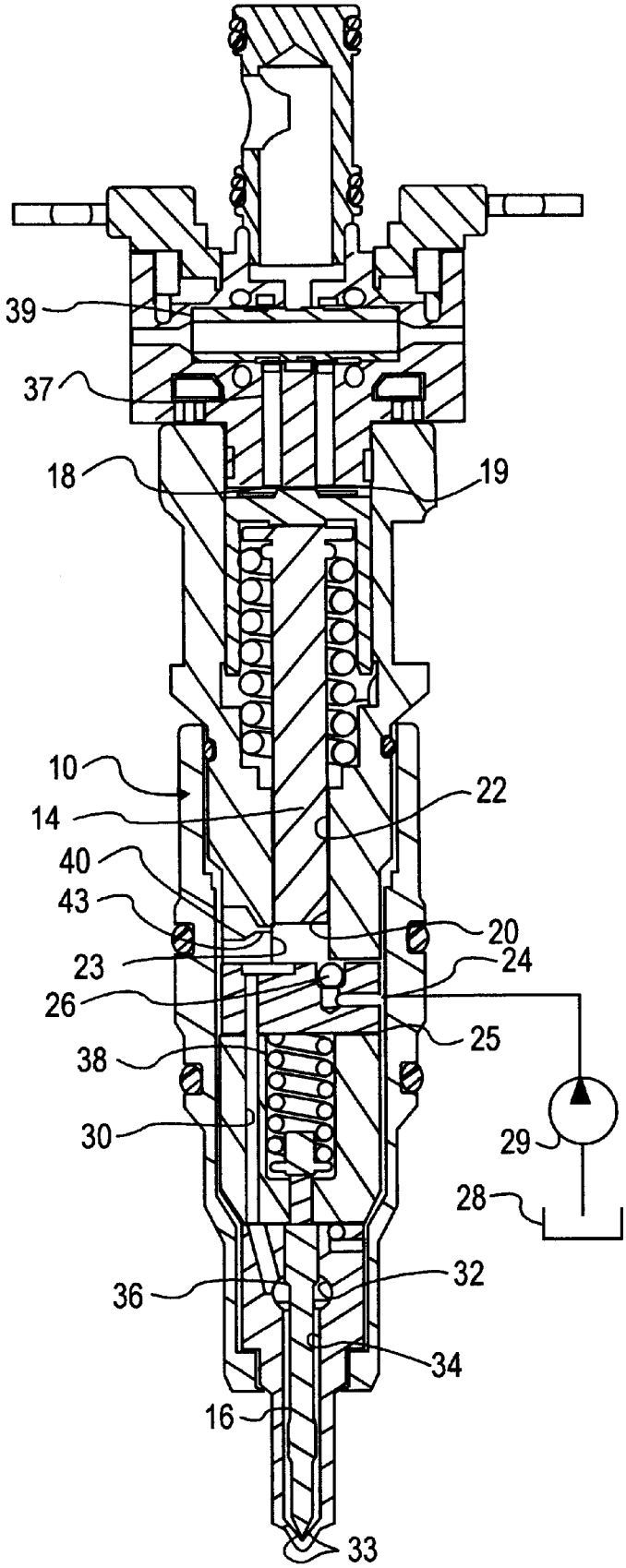
FIG. 7 is a cross-sectional view of an exemplary fuel injector incorporating a spill port of the first embodiment of the invention.

FIG. 7 is an exemplary fuel injector 10 illustrating a first embodiment of the invention. FIG. 3 depicts two major components of the exemplary fuel injector 10, the intensifier plunger 14 and the needle valve 16. The intensifier plunger 14 has an upper piston head 18 (FIG. 7) and a lower piston head 20. The intensifier plunger 14 is translatably disposed within a cylinder or barrel 22 defined in the fuel injector body. The portion of the cylinder 22 beneath the lower piston head 20 defines pressure chamber 23 which is of variable displacement due to the variable range of travel of the plunger 14. Downward translation of the plunger 14 acts to greatly increase the pressure of fuel in the pressure chamber 23 for injection into a combustion chamber.

Figure 4:
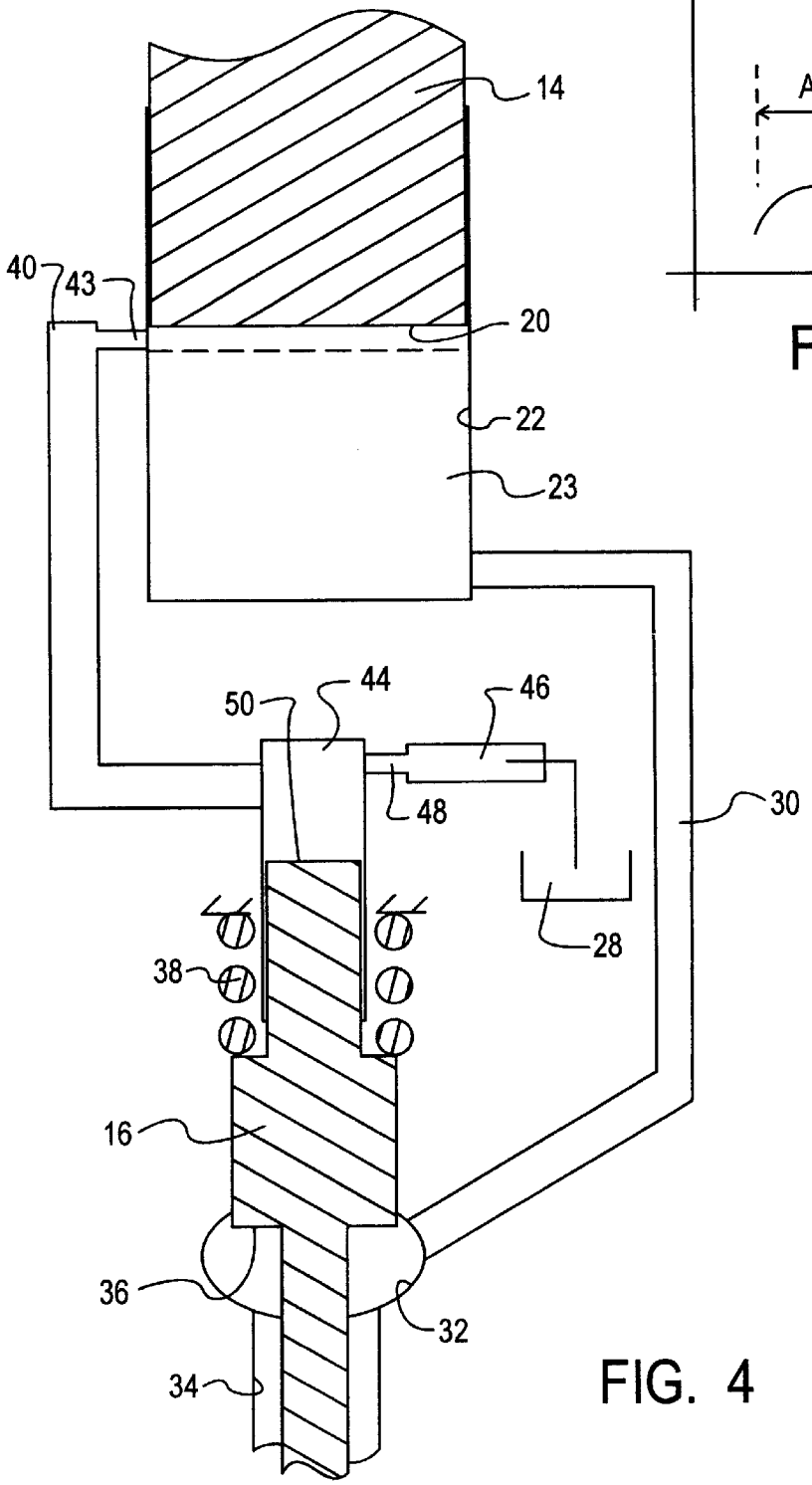
FIG. 4 is a schematic diagram of a second embodiment of the invention illustrating the fuel pressure intensification portion of a fuel injector having a spill passageway and a fuel injector needle valve where the spill passageway is fluidly coupled to the needle valve.
Figure 5:
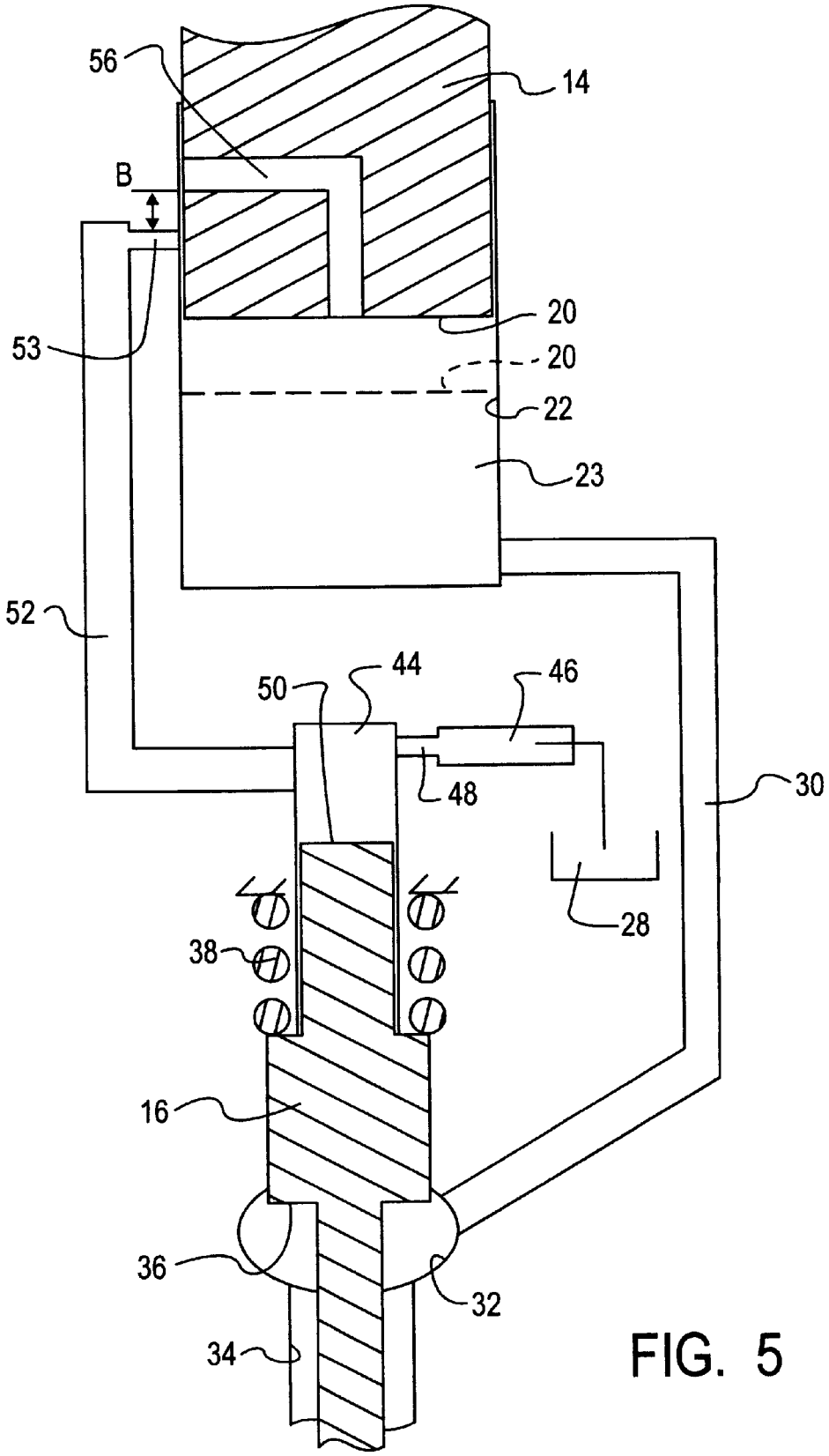
FIG. 5 is a schematic diagram of a third embodiment of the invention illustrating the fuel pressure intensification portion of a fuel injector having with a passive needle control passageway and a fuel injector needle valve including a needle control chamber.
Figure 6:
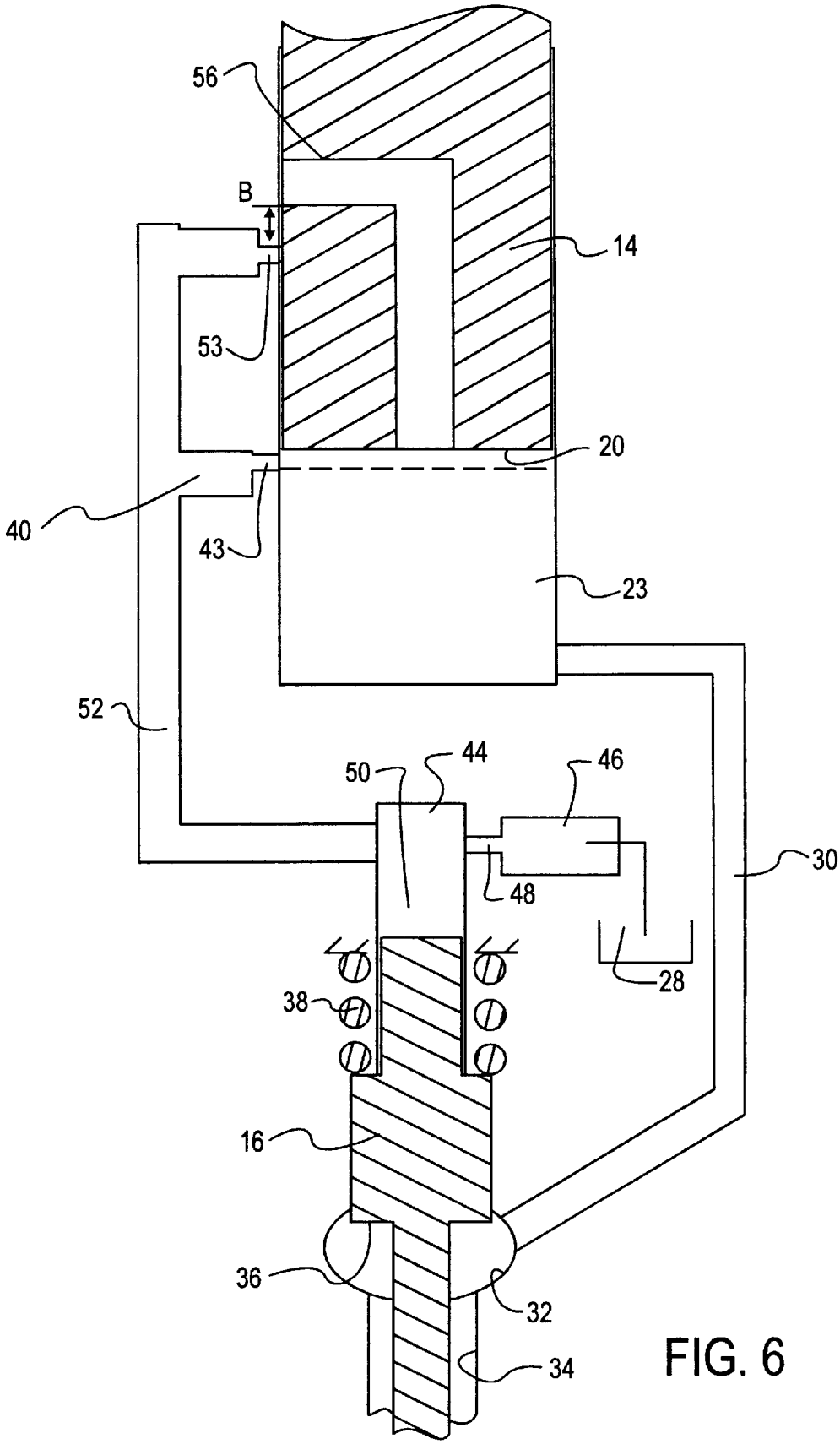
FIG. 6 is a schematic diagram of a fourth embodiment of the invention illustrating the fuel pressure intensification portion of a fuel injector having with both a spill passageway and a passive needle control passageway and a fuel injector needle valve including a needle control chamber.

The cylinder or barrel 22 has a fuel inlet 24 fed from annulus 25. Fuel flows into the cylinder pressure chamber 23 from a reservoir 28 and pump 29 to the annulus 25 through the fuel inlet 24 and a check valve 26. The fuel inlet pressure is typically 50 to 60 psi. The fuel inlet 24 in FIGS. 4 through 6 is similarly connected to a reservoir 28. The pressure chamber 23 is fluidly connected to the needle valve 16 by a fuel passageway 30.

The fuel passageway 30 of FIG. 3 is fluidly connected to an annular flow passageway 32 defined around the needle valve 16. The flow passageway 32 extends to orifices 33 that are sealed by the needle valve 16 when needle valve 16 is in the closed position (as depicted in FIG. 7) and open for fuel injection when the needle valve 16 is in an open disposition.

Needle valve 16 is translatably disposed within a cylindrical nozzle body 34. The needle valve 16 has an enlarged diameter surface 36 which faces the annular flow passageway 32. A valve spring 38 biases the needle valve 16 in a downward direction, as depicted in FIGS. 3 and 7, into the closed position.

In operation, a spool control valve 39 commences its translation from a closed position toward an open position. Such translation admits a high-pressure actuating fluid through passages 37 into a high pressure actuating fluid chamber 19 to bear on the upper piston head 18 of the intensifier plunger 14. The force exerted by the actuating fluid on the upper piston head 18 causes the intensifier plunger 14 to translate downward. The lower piston head 20 of the intensifier plunger 14 acts on the fuel captured within the pressure chamber 23 of the cylinder 22, greatly increasing the pressure of the fuel. The increased fuel pressure bears upwardly on the piston surface 36 of the needle valve 16. When sufficient upward force is generated on the piston surface 36 to overcome the bias of the valve spring 38, the needle valve 16 translates upward within the cylinder 34, opening the orifices 33 and discharging a charge of pressurized fuel through the orifices to the combustion chamber.

The present embodiment includes a spill passageway 40 fluidly coupled to the cylinder 22 through spill port 43. The spill port 43 is fluidly connected to the reservoir 28 (depicted schematically in FIG. 7). The positioning of the point of intersection of the spill passageway 40 and the cylinder 22 at spill port 43, with respect to the lower piston head 20 of intensifier plunger 14, is important. The spill port 43 is formed to a desired size, about 0.6 mm diameter, for providing a desired volume of flow under known conditions, and is disposed adjacently below the lower piston head 20, when the intensifier plunger 14 is in its retracted disposition, as depicted in FIGS. 3 and 7, so that the lower side of the spill port 43 is about 0.6 mm below the intensifier plunger in its retracted position. Although the port 43 could be spaced lower, such spacing could limit the maximum fuel delivery capacity of the injector.

During single shot injection operation, the initial translation of the downward stroke of the intensifier plunger 14 is controlled by the initial translation of the spool valve 39 from the closed position toward the open position. The initial downward translation of the intensifier plunger 14 occurs when the spool valve 39 is in a partial position of its full travel. Until the intensifier plunger 14 seals off the spill port 43, spillage from the pressure chamber 23 to the reservoir 28 occurs. During spillage, insufficient fuel pressure bears on needle surface 36 to overcome the bias of spring 38 and the needle valve 16 remains closed.

By the time the intensifier plunger 14 descends far enough such that the lower piston head 20 (depicted in dashed lines in FIG. 3) is below the lowest intersection of the spill port 43 of the spill passageway 40 with the cylinder 22, the spool valve 39 is operating in the region to the right of position 3 on trace 12 of FIG. 1 in the desirable stable region of operation. At this point, the spill port 43 is effectively sealed by the intensifier plunger 14 and spillage from pressure chamber 23 to reservoir 28 ceases. In this regard, a sharp corner between the lower piston head 20 and the circumferential surface of the plunger is believed to be important.

Until the lower piston head 20 closes the spill port 43 of the spill passageway 40, the intensifier plunger 14 does not greatly increase the pressure of the fuel trapped in the pressure chamber 23, since the fuel escapes from the pressure chamber 23 through the spill passageway 40 into the annulus 25 for further use. Once the spill passageway 40 is substantially sealed off by the intensifier plunger 14, fuel spillage ceases and the intensifier plunger 14 commences to increase the pressure of the fuel in the pressure chamber 23 of the cylinder 22. By spilling the fuel from pressure chamber 23 of the cylinder 22 through the spill passageway 40 during the initial phase of the stroke of the intensifier plunger 14, the period of instability resulting from a partial round-trip motion of the spool valve is effectively bypassed, thereby ensuring that the injector is operating in the region of stable, predictable fuel delivery.

As discussed above, the principal purpose of the spill port 43 of the injector shown in FIGS. 3 and 7 is to delay the start of injection relative to the start of the stroke movement of the intensifier plunger 14 until enough time has elapsed for the spool valve 39 to make a round trip from the closed position to the open position and back to the closed position. Although the exemplary injector described in FIGS. 3 and 7 incorporates this concept, this concept can also be used in any plunger-driven type injector, such as the HEUI and MEUI injectors described above.

During split injection (pilot injection) with the embodiment of FIGS. 3 and 7, the control valve 39 has to make a short minimum round trip for pilot injection and reopen again for a longer duration for main injection. In a manner similar to the single shot injection described above, pilot injection starts after the spill port 43 is covered by the intensifier plunger 14 and ends when the intensifier plunger 14 starts to return to the retracted position. The spill port 43 is designed in such a way, that fuel is spilled and, therefore, no injection starts during the time of partial control valve motion. Because of the injection delay caused by the fuel spilling, for same amount of control valve opening duration (pulse width), fuel delivery is much less with spilling concept of the present invention than that from the baseline injector of FIG. 8. Therefore, the minimum controllable pilot delivery is significantly smaller.

At low oil rail pressure, a minimum round trip signal at the control valve 39 could produce zero fuel delivery. This indicates that a relatively longer time for the control valve 39 to be on is required to generate certain fuel flow under certain oil rail pressures. In normal engine running conditions, low oil rail pressure (low injection pressure) occurs at low engine speed and under light engine load conditions. There is always enough time for longer injection system operation under these engine conditions. Injector performance, with the embodiment of FIGS. 3 and 7, is much more stable and reliable than the prior art embodiment of FIG. 8 since the control valve operates in the stable linear region.

At the end of pilot injection, the intensifier plunger 14 reverses its motion to stop the pilot injection (dwell period) as the control valve 39 returns to its closed position. The intensifier plunger 14 may or may not reopen the spill port 43 during its reversed motion depending on the amount of pilot quantity and amount of dwell. Pilot quantity is proportional to the intensifier plunger 14 stroke displacement during the pilot stage. The intensifier plunger 14 reverses its motion during dwell. If this reversing distance is relatively long, the intensifier plunger 14 opens spill port 43 again. This is illustrated in FIG. 3. The spill port 43 may not open when pilot injection is relatively larger and dwell is small. The spill port 43 may also reopen when the pilot injection is small and the dwell is relatively long. In this case, a smaller dwell command may be provided to the control valve 39 to adjust back this additional dwell caused by spilling compared to a baseline injector case.

The injector 10 of the embodiment of FIGS. 3 and 7 provides the following advantages:

No major injection event starts before the fuel spilling is complete. With the spill concept, the fuel injection pressure build-up process is either delayed or slowed down during spilling. Therefore, a measurable hydraulic delay is created and the beginning of the fuel injection event is delayed.

A predetermined hydraulic delay may be built into the injection system to delay the start of injection. This predetermined amount of delay is controlled by the flow area of the spill port 43 and the length of stroke of the intensifier plunger 14 required to close the spilling port 43.

By sizing the flow area of the spill port 43 correctly, all fuel deliveries will occur only after the control valve 39 reaches its linear and stable motion mode of operation. All fuel deliveries under partial control valve motion condition are eliminated.

Bypassing all partial control valve motion ensures the stability and controllability of the small quantity of fuel delivery possible with the present invention. Without bypass, a small quantity of fuel delivery always occurs under partial control valve motion.

The spill port 43 further reduces the minimum fuel delivery size to a preselected amount, of approximately 1 $mm^3$/stroke. With the present embodiment, the smallest pilot size is not dictated by the control valve capability, it is now controlled by a preselected spilling area. The minimum pilot quantity is controllable and could even be zero if desired.

The knee on the fuel delivery curve (see FIG. 1) is completely eliminated. The engine operates only on the linear portion of FIG. 1 rather than two zone operation (high gain and nonlinear region for small quantities, and linear lower gain for larger quantities). This indicates the improvement of engine operation in terms of smoothness, simplicity, controllability, and repeatability.

Since the initial portion of fuel is spilled to ambient without building up the injection pressure in the high-pressure fuel chamber, the amount of force resisting the motion of the intensifier plunger 14 during is reduced. Therefore, during spilling, the intensifier plunger 14 strokes downward faster. This faster initial intensifier plunger 14 translation directly translates into higher injection pressure (peak injection pressure) when injection starts.

Turning to FIG. 4, the embodiment of the present invention depicted therein is related to the previously described embodiment depicted in FIG. 3. In the embodiment of FIG. 4, the spill passageway 40 is directed to a needle back chamber 44 defined in the nozzle body 34. Fuel spilled from the pressure chamber 23 of the cylinder 22 during the initial downward translation of the intensifier plunger 14 is forced through the spill port 43 and spill passageway 40 to flow into the variable volume chamber 44. An outlet or needle back vent passageway 46 is fluidly coupled to the chamber 44 through a drain port 48.

The drain port 48 has two functions: first, it restricts the flow from the needle back chamber 44 to the reservoir 28. By having this restriction, a significant amount of fuel pressure in the needle back chamber 44 can be trapped, preventing needle lifting during the spilling portion of the stroke of intensifier plunger 14. Second, it allows fuel in the needle back chamber 44 to vent through passageway 46 to the fuel reservoir 28.

Due to the restriction caused by the drain port 43, the fuel pressure in pressure chamber 23 is nearly the same level during the spill portion of the stroke that it would be if the spill port were not present. The intensifier plunger 14 motion therefore is slower than in the case of the embodiment of FIG. 3 due to the higher resisting pressure and spilling the fuel to the needle back chamber 44 becomes relatively difficult and slow. However, because of the constant leakage at drain port 48, the intensifier plunger 14 will always move downward and eventually close the spill port 43. Compared to the embodiment of FIG. 3, since the time required to bypass all partial motion of the spool valve is the same, the slower spill rate of this embodiment requires a smaller spill port to result in the same amount of bypass time. This provides the advantage of a lower spill volume of pressurized fuel back to the fuel reservoir and less energy consumption of the hydraulic actuation fluid.

The size (flow area) of the drain port 48 has a big impact on the needle back pressure during the entire injection event and has to be properly selected. The flow area of the drain port 48 needs to be equal or smaller than the flow area of the spill port 43 to assure the proper function. The flow area ratio of drain port 48 to spill port 43 should be equal or less than 1.0. With this area ratio, the needle back chamber 44 will have relatively high pressure during the spill portion of the plunger stroke and will drop to fuel reservoir pressure when the spill flow is stopped.

During the spill portion of the plunger stroke, the drain port 48 provides continued leakage between the needle back chamber 44 to the fuel vent passageway 46 and reservoir 28. However, if this continued leakage rate is higher than the spill rate from spill port 43 (when area ratio is higher than 1.0), very little pressure would be trapped on the needle back chamber 44. Because of the continued leakage from drain port to vent passageway, pressure at the needle back chamber will quickly drop to the fuel reservoir pressure level as soon as the spill flow is cut off. This is referred as the venting process. If the drain port 48 were too small, the time to vent after spill port closure would be excessive and the needle valve 16 lifting process would be relatively long. The drain port 48 also provides a continued venting function after the spill port 43 is closed. The proper combination of both the spill port 43 and drain port 48 function is the foundation for all three embodiments illustrated in FIGS. 4–6.

The needle valve 16 is slidably disposed in the nozzle body 34 and in a portion of the chamber 44. An upper needle valve margin 50 defines in part the needle back chamber 44. Although shown schematically herein as disposed at the end of the needle valve 16, it will be appreciated that, as is known in the art, the needle back chamber 44 could be disposed about an intermediate portion of the needle valve having a needle back surface in the form of an upwardly facing enlarged diameter needle valve portion exposed to the needle back chamber 44 so long as fuel pressure in the needle back chamber 44 urges the needle valve 16 to a closed position.

In operation, the spilling of the fuel in the pressure chamber 23 of the cylinder 22 that occurs during the initial downstroke of the intensifier plunger 14 of the embodiment of FIG. 4 accomplishes the same effect as the embodiment of FIG. 3, in that, the region of partial spool motion is bypassed, as previously described. In addition to this bypass function, the embodiment of FIG. 4 provides indirect control of the lift of the needle valve 16. This is accomplished by two facts. First, spilling the fuel to the needle back prevents the needle valve 16 from lifting and the start of the injection is delayed. Second, after the intensifier is plunger 14 seals off the intersection of the spill passageway 40, the needle back pressure drops to reservoir level and the needle valve 16 lifts up to begin injection. Depending on the selection of the drain port 48 size, the venting of the spill fuel pressure to the reservoir and the needle lifting speed can be controlled at desired range. The advantage of such control is that it produces a slow initial lift of the needle valve 16 which effects a rate shaping by throttling the initial rate of fuel injection, as indicated in the region A of FIG. 4*a*. Such rate shaping is desirable to optimize engine emissions and reduce noise.

The injector 10 of the embodiment of FIG. 4 provides the following advantages:

It is expected that no major injection events will start before spilling finishes. With the spill concept, the fuel injection pressure build-up process is either delayed or slows down during spilling. Therefore, a measurable hydraulic delay is created and the injection event can be delayed.

A pre-determined hydraulic delay can be built into the injection system to delay the start of injection. This pre-determined delay is controlled by the size or stroke of the spill port relative to plunger motion.

By sizing the spill port correctly, all fuel deliveries occur only after the control valve reaches a linear and stable mode of motion. All fuel deliveries under partial control valve motion condition are bypassed.

Using a spill port further reduces the minimum fuel delivery size to a preselected amount, preferably 1 mm3. The smallest pilot quantity is no longer dictated by the control valve capability, it is controlled by a pre-selected spilling area.

The knee on the fuel delivery curve is completely eliminated. The engine operates only on the linear portion rather than two zone operation (high gain and non linear region for small quantity, and linear lower gain for larger quantity). This indicates the improvements of engine operation in terms of smoothness, simplicity and controllability.

Since fuel is spilled to needle back rather than ambient, a considerable amount of spill volume is reduced.

The opening of the needle valve 16 is controlled not only by plunger bottom pressure, but also by the needle back pressure, which is a result of spilling. This approach provides a more efficient way to control the needle valve motion.

Turning now to the embodiment of FIG. 5, a control passageway 52 of predetermined size is fluidly coupled between the pressure chamber 23 defined in the cylinder 22 and the needle back chamber 44 of the nozzle body 34. The needle back chamber 44 and drain port 48 therefrom are the same as described in the embodiment of FIG. 4. The location of the control port 53 at the point of intersection of the control passageway 52 with the cylinder 22 is such that, in the retracted position of FIG. 5 and prior to the downstroke of the intensifier plunger 14, the control port 53 of the passageway 52 is sealed off by the intensifier plunger 14. Accordingly, during the initial downstroke of the intensifier plunger 14, fuel pressure in the pressure chamber 23 of the cylinder 22 is increased by the compressive effects of the downstroke of the intensifier plunger 14, since no spilling occurs.

When the intensifier plunger 14 has traveled downward a distance indicated by the distance B to the position shown in phantom in FIG. 5, a flow passageway 56, defined within the intensifier plunger 14 momentarily fluidly couples the fuel in the pressure chamber of the cylinder 22 to the spill passageway 52. The flow passageway 56 is of predetermined diameter, preferably about the same size as the passageway 52. Porting of fuel from the pressure chamber 23 to the needle back chamber 44 and venting from the needle back chamber 44 through drain port 48 occurs at this time. The embodiment of FIG. 5 is useful to achieve split injection as depicted in FIG. 9. As depicted, there is a pilot injection followed by a period of time during which no injection occurs (when the flow passageway 56 is open to the spill port 43), followed by the main injection event. To achieve such split injection with the prior art injector of FIG. 8, the spool must make two round trips, the first round trip defining the pilot injection and the second round trip defining the main injection event.

With the embodiment of FIG. 5, split injection is caused passively. No double round trip of the spool is required. Effectively, the spool moves from the closed position to the open position and is held there. Such translation starts the intensifier plunger 14 in its downstroke. Fuel pressure in the pressure chamber 23 of the cylinder 22 starts to build. When the fuel pressure exerts enough force on the piston surface 36 to overcome the bias of the valve spring 38, the needle valve 16 opens for the pilot injection event. As the intensifier plunger 14 continues in its downstroke, the flow passageway 56 opens to the control port 53. At this point, fuel flows from the cylinder 22 through the flow passageway 56 to the control passageway 52 into the chamber 44. The reduction of the pressure in cylinder 22 plus the increase of pressure in chamber 44 causes the needle valve 16 to close, thus ending the pilot injection.

Figure 4A:
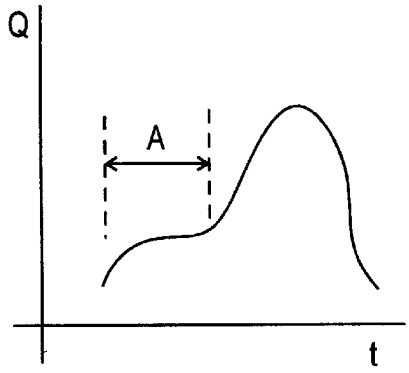

The needle valve 16 remains closed for a short period of time while the flow passageway 56 and the control port 53 are fluidly coupled. This defines the dwell time between the pilot injection event and the main injection event. When the flow passageway 56 descends below the control port 53, the intensifier plunger 14 again seals off the control passageway 52. Continued downward translation of the intensifier plunger 14 causes the fuel in the pressure chamber 23 to again be pressurized to a high level. When the fuel pressure exerts a force on the needle valve opening surface 36 sufficient to overcome the bias of the valve spring 38, the needle valve 16 commences an upward motion controlled by the rate at which the needle valve 16 is able to expel fuel from the chamber 44 out through the drain port 48 to the vent passageway 46. The pressure of the actuating fluid to the intensifier chamber 19 or passageway sizes 52, 46 can be adjusted such that instead of providing a split injection as indicated in FIG. 9, the injection event is rate controlled as depicted in FIG. 4*a,* the spill occurring for such a short duration that there is only a dip in the rate of fuel injection as distinct from the cessation of fuel injection that occurs in a pilot injection.

The embodiment of FIG. 5 provides the following advantages:

Needle valve motion is controlled passively during injection to throttle the initial rate of fuel injection by a low-cost passive mechanical device, avoiding the need for additional commands to the control valve. No separate actuation control is required to effect this control.

Pilot quantity is reduced to a desired volume of 1–2 $mm^3$/stroke.

There is no spool double travel required. Only a single round trip is required to provide an injection event that includes either split injection or rate shaping as desired. This feature has particular advantage on large injector applications where a large control valve is used. Because of a large fuel delivery quantity requirement, the minimum pilot size would increase due to a longer control valve travel time, a larger oil flow rate and a larger injection nozzle orifice size. If two control valve round trips are used for split pilot injection, the pilot size would be unacceptable. By applying the approach of the present invention and utilizing an appropriate control port, small pilot injection quantities can be achieved.

By varying the control port design, different rate shaping effects can be achieved and can be optimized by conducting engine performance and emission tests. For split injection, pilot size and dwell can also be controlled.

Finally, the peak main injection pressure is increased due to increased intensifier plunger 14 momentum as a result of acceleration during spilling.

In the embodiment of FIG. 5, passive control of the needle valve or check is controlled by spilling a portion of the injection pressure in a controlled manner to the back side of the needle to bear on the needle valve margin 50. Although the invention of this embodiment may be used with the exemplary injector described in FIG. 7, it is understood that the invention is equally applicable in any plunger-driven type injector, such as HEUI and MEUI injectors.

The embodiment of FIG. 6 combines the features of the embodiments of FIGS. 4 and 5. Operation of the features is essentially as previously described with reference to FIGS. 4 and 5. The embodiment of FIG. 6 provides the following advantages: the region of partial spool motion is bypassed; no double spool motion is required in order to provide for pilot injection and main injection events, the opening and closing translations of the needle valve 16 are passively controlled by means of the fluid in chamber 44 against which the needle valve 16 must operate; and split injection or rate shaping of the injection event is provided for as desired by passive means, without additional control inputs to the fuel injector.

In the embodiment of FIG. 6, the start of fuel injection is delayed relative to the start of intensifier plunger 14 movement until enough time has elapsed for the spool valve 39 to make a round trip from the closed position to the open position and back to the closed position. Additionally, passive control of the needle valve 16 is provided by spilling a portion of the injection pressure in a controlled manner to the needle back chamber 44 of the needle valve 16.

As illustrated in FIG. 6, a spill passageway 40 fluidly coupled through a spill port 43 to the cylinder 22. The spill passageway 40 is fluidly connected through control passage 52 to needle back chamber 44 of the needle valve 16. The spill port 43 is disposed adjacently below the lower piston head 20, to be open when the intensifier plunger 14 is in its retracted disposition.

Further, a control port 53 is designed to intersect the high-pressure fuel chamber 23. The control port 53 is sealed by the intensifier plunger 14 when the intensifier plunger 14 is in the retracted position. The control port 53 is connected through a control passage 52 to needle back chamber 44 at the back of the needle valve 16. A drain port 48 connects the vent passageway 46 to the reservoir 28 as discussed above.

In the intensifier plunger 14, a passage 56 is cut through its bottom face through its sidewall 57, allowing fuel to flow out to the needle back chamber 44 when the control port 53 and passage 56 are aligned together. As the intensifier plunger 14 retracts up and strokes down, the passage 56 is alternatively blocked, fully connected with control port 53 or partially connected to the control port 53. The percentage of the intensifier plunger movement when control port 53 is open (port schedule) is a function of position of the intensifier plunger 14 and the control port design. By varying the control port 53 design and the spill port 43 design, different port schedules can be achieved which result in different injector performance characteristics.

The common characteristics in various spill port schedule designs for this concept are explained as follows. The spill port 43 is open when the intensifier plunger 14 starts to stroke downward, as depicted in FIG. 6. Because of spilling to chamber 44, pressure at the pressure chamber 23 is low and no injection will occur. This is the bypass stage of spilling. As the intensifier plunger 14 strokes downward, the spill port 43 starts to close.

During the closing of spill port 43, or after the spill port 43 is completely closed, depending on different spill port designs, injection will start due to the high pressure in the pressure chamber 23, acting to open the needle valve 16. At this moment, the region of partial spool motion of the control valve has already been bypassed. As soon as the start of fuel delivery (only a very small quantity of fuel is injected at this point), the control port 53 opens to let fuel flow to the needle back chamber 44. Such high pressure fuel acts to urge the needle valve 16 downward toward the closed position. This needle valve 16 closing results in either split injection operation or rate shaping operation, depending on the particular design of spill port 43. When the intensifier plunger 14 strokes further downward, the control port 53 starts to close, and the pressure at the needle back chamber 44 starts to decay. This allows the needle valve 16 to open again and to reach its full lift position. The main injection event starts.

When an electronic opening command signal is given to the control (spool) valve, the control valve opens and actuating fluid (oil) flows into the intensifier actuation chamber to act on the intensifier plunger 14. The intensifier plunger 14 starts to stroke downward. At this moment, the spill port 43 is open. Due to spilling, pressure in the pressure chamber 23 is low, pressure on top of needle back 50 is high, the needle valve is, therefore, not able to lift, and no injection occurs. As the intensifier plunger 14 strokes further downward, spill port 43 starts to close, pressure under the intensifier plunger in pressure chamber 23 starts to build up, needle back 50 pressure starts to drop. When the nozzle chamber 32 pressure, acting upward on the needle valve 16, is high enough to overcome the load of the needle valve spring 38 and the pressure load on the needle back 50, the needle valve 16 lifts up and injection starts.

At this point, the region of partial control valve spool motion has been bypassed. After a small quantity of fuel delivery, the control port 53 starts to open as the intensifier plunger 14 strokes further downward. A portion of fuel in the high-pressure chamber 23 flows through the control port 53 to the needle back chamber 44. At this moment, nozzle chamber pressure drops due to fuel spilling and, at the same time, pressure at the needle back 50 increases. This prevents the needle valve 16 from lifting further or even causes the needle valve 16 to close, depending on different control port 53 designs and engine operating conditions. During the period of spilling via control port 53, rate shaping or split injection can be achieved. When the intensifier plunger 14 continues to stroke downward, the spill port 43 gradually closes. Nozzle chamber pressure builds up again, pressure at needle back 50 decays as fuel vents through the drain port 48, and the main injection event starts. It should be noted that because of spilling through control port 53, pressure at the pressure chamber 23 is reduced. This results in the intensifier plunger 14 stroking downward with a higher speed. This increased momentum of intensifier plunger results in higher peak fuel injection pressure.

At the end of the injection event, an electronic signal is sent to the control spool valve and the control valve closes. As a consequence, pressure at the intensifier chamber 23 drops and the intensifier plunger 14 starts to retract upward to its initial retracted position, as depicted in FIG. 6. Nozzle chamber pressure also drops and needle valve 16 is closed by needle spring 38 load. Fuel fills the pressure chamber 23 through a check valve 26 (see FIG. 3) and the needle back chamber 44 through the drain port 48. When another signal is sent to the control spool valve, a new injection event will start.

As described above, the fuel injector of the present invention provides a number of advantages some of which have been described above and others of which are inherent in the invention. It will be appreciated by those of ordinary skill in the art in view of the foregoing description of the invention that many alternatives, modifications, and variations may be made in the invention without departing from the teachings herein. Accordingly, the invention should be not limited except in conformance with the spirit and broad scope of the accompanying claims.

What is claimed is:

1. A fuel injector for generating a fuel injection event in the combustion chamber of an internal combustion engine, having a controller being shiftable from a first disposition toward a second disposition and returnably shiftable to the first disposition thereby defining initiation and termination of an injection event, such shifting acting to port an actuating fluid to stroke an intensifier plunger for compressing fuel in an intensifier pressure chamber, the intensifier pressure chamber having a fuel inlet port and being defined in part by a plunger head and further being in fluid communication with a needle valve, comprising;

at least a first spill port being operably disposed in fluid communication with the intensifier pressure chamber and being spaced apart from the plunger head when the intensifier plunger is in a retracted disposition, the spill port spilling fuel from the pressure chamber for a select duration of time after initiation of the intensifier plunger compressive stroke motion such that no fuel injection occurs during the select duration of time, termination of the select duration of time occurring when the plunger head seals off the first spill port, the intensifier plunger being directly fluidly in communication with a needle valve surface, fuel pressure on the surface acting to open the needle valve, the motion of the compressive stroke motion of the intensifier plunger generating fuel pressure at an injectable level acting on the needle valve surface to provide substantially continuous injected fuel from the time that the plunger head seals off the first spill port until interruption of the compressive stroke motion.

2. The fuel injector of claim 1 wherein translation of the intensifier plunger a preselected distance from the first retracted disposition acts to substantially seal off the spill port and the spill passageway.

3. The fuel injector of claim 2 wherein the spill passageway has a redetermined flow area.

4. The fuel injector of claim 1 wherein the duration of fuel spilling is substantially equal to the minimum duration of time required for the controller to make a round trip from the first disposition to the second disposition and back to the first disposition.

5. The fuel injector of claim 2 wherein the intensifier plunger is translatable in the intensifier pressure chamber between the first retracted disposition and a second disposition at full stroke, the spill port being disposed adjacent a head of the intensifier plunger when the intensifier plunger is in the first retracted disposition.

6. The fuel injector of claim 1 wherein the spill passageway is in fluid communication with a relatively low pressure fuel reservoir disposed external to the fuel injector.

7. The fuel injector of claim 1 wherein the spill passageway effects spilling of fuel from the pressure chamber for a time after commencement of the stroke of the intensifier plunger, the time being of sufficient duration to ensure that the controller is operating in a stable and predictable mode of fuel delivery operation.

8. The fuel injector of claim 1 wherein the spill passageway has a predetermined flow area.

9. The fuel injector of claim 8 wherein the spill passageway flow area is predetermined to ensure spillage of fuel for a time duration of sufficient length to permit the controller to make a round trip from the first disposition to the second disposition and back to the first disposition.

10. The fuel injector of claim 1 wherein the spill passageway effects a selected hydraulic delay between the initiation of an actuation command to the controller and the commencement of fuel injection.

11. A hydraulically-actuated, electronically controlled fuel injector comprising:

a control valve spool that is electronically actuated, translation of said control valve spool from a first position to a second position acting to port an actuating fluid to an intensifier plunger responsive to an electronic actuation command, the intensifier plunger compressively stroking under the urging of the actuating fluid, the stroke increasing the pressure of fuel in an intensifier pressure chamber, the intensifier pressure chamber having a fuel inlet, the fuel being deliverable directly from the intensifier pressure chamber to a needle valve orifice for injection into the combustion chamber of an internal combustion engine, the intensifier pressure chamber being in fluid communication with a needle valve opening piston surface during fuel injection, the injection fuel under pressure acting on the needle valve opening piston surface to effect translation of the needle valve and to thereby open the needle valve orifice;

a spill port in fluid communication with the intensifier pressure chamber, the spill port being spaced apart from the intensifier plunger prior to initiation of the intensifier plunger compressive stroke and being open for at least a portion of the stroke of the intensifier plunger for spilling fuel from the intensifier pressure chamber, the spilling of fuel effecting a hydraulic delay in commencement of fuel injection, the delay occurring between the electronic actuation of the control valve and closing of the spill port by the intensifier plunger during the intensifier plunger compressive stroke.

12. The fuel injector of claim 11 wherein a flow area of the spill port is selected to effect a desired hydraulic delay.

13. The fuel injector of claim 12 wherein the duration of hydraulic delay is selected to be substantially coterminous with a period of partial control valve translation.

14. The fuel injector of claim 13 wherein the control valve is translatable from a first disposition to a second disposition and returnably translatable to the first disposition, such translation defining a round trip, a partial control valve translation being less than a round trip.

15. The fuel injector of claim 13 wherein the hydraulic delay effected by the spill port substantially prevents fuel injection during the period of partial control valve translation.

16. The fuel injector of claim 11 wherein the spillage through the spill port effects an acceleration of the intensifier plunger stroke resulting in greater intensifier plunger momentum.

17. The fuel injector of claim 14 wherein the fuel delivery volume during a minimum round trip per intensifier plunger stroke is substantially 1 $mm^3$.

18. The fuel injector of claim 11 wherein the spill port is in fluid communication with a pressure bearing surface of the needle valve, spilled fuel pressure acting on the pressure bearing surface being opposed to the injection fuel under pressure acting on the needle valve to effect translation of the needle valve and to thereby open the needle valve orifice.

19. The fuel injector of claim 18 wherein the opposition to an opening force developed by the injection fuel under pressure acting on the needle valve acts to control the opening of the needle valve orifice for delivery of a reduced fuel injection volume.

20. The fuel injector of claim 18 wherein the opposition to an opening force developed by the injection fuel under pressure effects passive control of the opening of the needle valve orifice.

21. The fuel injector of claim 20 wherein the passive control of the opening of the needle valve orifice provides for limited initial injection volumes useful in rate shaping of the injection event and in pilot injection preceding a main injection event.

22. The fuel injector of claim 18 wherein the spill port provides for passive rate shaping of the injection event and pilot injection preceding a main injection event during a single round trip of the control valve, the single round trip of the control valve generating the full injection event.

23. The fuel injector of claim 18 further including a needle back chamber formed in part by the pressure bearing surface of the needle valve and in fluid communication with the spill port, the needle back chamber being vented by a needle back vent passage to a relatively low pressure area, the needle back vent passage having a flow area that is sized to throttle a flow of fuel from the needle back chamber as desired to effect a desired control of the needle valve opening and closing.

24. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the intensifier pressure chamber having a fuel inlet port and being in direct fluid communication with a surface during the injection of fuel, a certain pressure bearing on the surface acting to open the needle valve, the fuel injector comprising:

a spill port intersecting the cylinder wall, the spill port being variably openable and closeable by the intensifier plunger during the translating motion of the intensifier piston for spilling fuel from the variable volume intensifier pressure chamber as desired such that no fuel injection occurs while the spill port is open.

25. The fuel injector of claim 24 wherein the spill port includes a spill passageway defined in an injector body and being fluidly coupled to a low pressure area for the spilling of fuel to the low pressure area.

26. The fuel injector of claim 25 wherein the low pressure area is a fuel reservoir disposed external to a fuel injector body.

27. The fuel injector of claim 24 wherein the spill port includes a predetermined flow area.

28. The fuel injector of claim 24 further including a needle valve, the needle valve being translatable between an open position and a closed position, a fuel injection orifice being open in the needle valve open disposition, the needle valve having a needle back surface, the needle back surface defining in part a needle back chamber, the fuel injector further comprising:

the spill port including a spill passageway defined in an injector body and being fluidly coupled to the needle back surface.

29. The fuel injector of claim 28 wherein fuel under pressure spilled through the spill port acts on the needle back surface to control translation of the needle valve.

30. The fuel injector of claim 29 wherein fuel under pressure spilled through the spill port acts on the needle back surface to oppose forces acting on the needle valve tending to urge the needle to the open position.

31. The fuel injector of claim 28 further including a needle back vent passage, the needle back vent passage being in fluid communication with the needle back surface for venting of fuel therefrom.

32. The fuel injector of claim 31 further wherein the needle back vent passage is in fluid communication with a source of fuel disposed external to the injector.

33. The fuel injector of claim 32 further wherein the needle back vent passage is in fluid communication with a source of fuel disposed external to the injector for the venting of fuel thereto.

34. The fuel injector of claim 33 further wherein flow of fuel in the needle back vent passage is two way for selective venting of fuel from the needle back surface and for replenishing a volume of fuel at the needle back surface.

35. The fuel injector of claim 24 wherein the spill port is disposed adjacent an intensifier plunger lower piston head when the intensifier plunger is at the retracted disposition, the lower piston head for acting on fuel in the variable volume intensifier pressure chamber to increase the pressure thereof.

36. The fuel injector of claim 24 wherein the intensifier plunger acts cooperatively with the spill port to control the beginning of fuel injection.

37. The fuel injector of claim 24 wherein the intensifier plunger acts cooperatively with the spill port to delay the beginning of fuel injection with respect to initiation of intensifier plunger motion.

38. The fuel injector of claim 24 wherein the intensifier plunger acts cooperatively with the spill port to delay the beginning of fuel injection with respect to initiation of actuation of an injector control valve.

39. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the intensifier pressure chamber having a fuel inlet port and being in direct fluid communication with a surface during the injection of fuel, a certain pressure bearing on the surface acting to open the needle valve, the fuel injector comprising:

a control valve having a spool shiftable between a first position and a second position, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired such that no fuel injection occurs until the spill port is closed by the intensifier plunger.

40. The fuel injector of claim 39 wherein the spill port is disposed adjacent to an intensifier plunger lower piston head when the intensifier plunger is at the retracted disposition, the lower piston head for acting on fuel in the variable volume intensifier pressure chamber to increase the pressure thereof.

41. The fuel injector of claim 39 wherein the spill port is disposed spaced apart from the intensifier plunger lower piston head less than 1.0 mm when the intensifier plunger is at the retracted disposition.

42. The fuel injector of claim 39 wherein the bottom of the spill port is disposed 0.6 mm from the intensifier plunger lower piston head when the intensifier plunger is at the retracted disposition.

43. The fuel injector of claim 39 wherein the spill port diameter is 0.6 mm.

44. The fuel injector of claim 39 wherein the intensifier plunger acts cooperatively with the spill port to control the beginning of fuel injection.

45. The fuel injector of claim 39 wherein the intensifier plunger acts cooperatively with the spill port to delay the beginning of fuel injection with respect to initiation of intensifier plunger valve motion.

46. The fuel injector of claim 39 wherein the intensifier plunger acts cooperatively with the spill port to delay the beginning of fuel injection with respect to initiation of actuation of the injector control valve spool.

47. The fuel injector of claim 42 wherein the intensifier plunger acts cooperatively with the spill port to delay the beginning of fuel injection with respect to initiation of actuation of the injector control valve spool for a duration that is at least equal in duration to a time of a minimum round trip of the control valve spool.

48. The fuel injector of claim 47 wherein the intensifier plunger acts cooperatively with the spill port to delay the beginning of fuel injection with respect to initiation of actuation of the injector control valve spool for a duration that is at least equal in duration to a time of a minimum round trip of the control valve spool.

49. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber and being in direct fluid communication with a surface during an injection of fuel, a certain pressure bearing on the surface acting to open an injector needle valve to effect the fuel injection, the intensifier pressure chamber having a fuel inlet port, the fuel injector comprising:

a first control port, the control port being variably openable and closeable by the intensifier plunger during the translating motion of the intensifier piston for spilling fuel from the variable volume intensifier pressure chamber as desired to control the opening motion of the injector needle valve such that no fuel injection occurs when the control port is open.

50. The fuel injector of claim 49 wherein the control port includes a control port passageway, the control port passageway being fluidly coupled to a needle valve needle back surface.

51. The fuel injector of claim 50 wherein fuel under pressure spilled through the control port acts on the needle back surface to control translation of the needle valve.

52. The fuel injector of claim 51 wherein fuel under pressure spilled through the control port acts on the needle back surface to oppose a force acting on the needle valve tending to urge the needle valve to an open position.

53. The fuel injector of claim 50 further including a needle back vent orifice, the needle back vent orifice being in fluid communication with the needle back surface for venting of fuel therefrom.

54. The fuel injector of claim 53 further wherein the needle back vent orifice is in fluid communication with a source of fuel disposed external to the injector.

55. The fuel injector of claim 54 further wherein the needle back vent orifice is in fluid communication with a source of fuel disposed external to the injector for the venting of fuel thereto.

56. The fuel injector of claim 55 further wherein flow of fuel in the needle back vent orifice is two way for selective venting of fuel from the needle back surface and for replenishing a volume of fuel at the needle back surface.

57. A fuel injector having an intensifier plunger and a needle valve, the intensifier plunger being translatable in a cylinder between a retracted position and a full stroke position, the cylinder being defined by a cylinder wall, the cylinder wall defining in part a variable volume intensifier pressure chamber, the needle valve being translatable between an open position and a closed position, a fuel injection orifice being open in the needle valve open disposition, the needle valve having a needle back surface, the needle back surface defining in part a needle back chamber, the fuel injector comprising:

a control port including a control port passageway being fluidly couplable to the needle back surface.

58. The fuel injector of claim 57 wherein fuel under pressure spilled through the control port acts on the needle back surface to control translation of the needle valve.

59. The fuel injector of claim 58 wherein fuel under pressure spilled through the control port acts on the needle back surface to oppose a force acting on the needle valve tending to urge the needle to the open position.

60. The fuel injector of claim 57 further including a needle back vent orifice, the needle back vent orifice being in fluid communication with the needle back surface for venting of fuel therefrom.

61. The fuel injector of claim 60 further wherein the needle back vent orifice is in fluid communication with a source of fuel disposed external to the injector.

62. The fuel injector of claim 61 further wherein the needle back vent orifice is in fluid communication with a source of fuel disposed external to the injector for the venting of fuel thereto.

63. The fuel injector of claim 62 further wherein flow of fuel in the needle back vent orifice is two way for selective venting of fuel from the needle back surface and for replenishing a volume of fuel at the needle back surface.

64. The fuel injector of claim 57 wherein a controlling spillage of fuel occurs at a time subsequent to initiation of intensifier plunger motion, the controlling spillage effecting a split injection of fuel injected from the fuel injection orifice.

65. The fuel injector of claim 57 wherein a controlling spillage of fuel occurs at a time subsequent to initiation of intensifier plunger motion, the controlling spillage effecting a rate shaping of fuel injected from the fuel injection orifice.

66. The fuel injector of claim 57 wherein a controlling spillage of fuel occurs at a time subsequent to initiation of intensifier plunger motion, the controlling spillage effecting passive control of needle valve closing during an injection event.

67. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the fuel injector comprising:

a first control port, the first control port being variably openable and closeable by the intensifier plunger during the translating motion of the intensifier piston for spilling fuel from the variable volume intensifier pressure chamber as desired to control the opening motion of an injector needle valve; and a second control port, the second control port being variably openable and closeable by the intensifier plunger during the translating motion of the intensifier piston for spilling fuel from the variable volume intensifier pressure chamber as desired to control the opening motion of the injector needle valve.

68. The fuel injector of claim 67 wherein fuel under pressure spilled through the control port acts on a needle surface to urge the needle valve to a closed position.

69. The fuel injector of claim 68 wherein fuel under pressure spilled through the control port acts on the needle surface to oppose a force acting on the needle valve tending to urge the needle to the open position.

70. The fuel injector of claim 67 further including a needle vent orifice, the needle vent orifice being in fluid communication with the needle surface for venting of fuel therefrom.

71. The fuel injector of claim 70 further wherein the needle vent orifice is in fluid communication with a source of fuel disposed external to the injector.

72. The fuel injector of claim 71 further wherein the needle vent orifice is in fluid communication with a source of fuel disposed external to the injector for the venting of fuel thereto.

73. The fuel injector of claim 72 further wherein flow of fuel in the needle vent orifice is two way for selective venting of fuel from the needle surface and for replenishing a volume of fuel at the needle surface.

74. The fuel injector of claim 57 wherein a controlling spillage of fuel occurs at a time subsequent to initiation of intensifier plunger motion, the controlling spillage effecting a split injection of fuel injected from the fuel injection orifice.

75. The fuel injector of claim 57 wherein a controlling spillage of fuel occurs at a time subsequent to initiation of intensifier plunger motion, the controlling spillage effecting a rate shaping of fuel injected from the fuel injection orifice.

76. The fuel injector of claim 57 wherein a controlling spillage of fuel occurs at a time subsequent to initiation of intensifier plunger motion, the controlling spillage effecting passive control of needle valve closing during an injection event.

77. The fuel injector of claim 57 wherein a controlling spillage of fuel occurs at a time subsequent to initiation of intensifier plunger motion, the controlling spillage effecting bypass of a partial motion of a control spool valve.

78. A fuel injector for generating a fuel injection event in the combustion chamber of an internal combustion engine, having a controller being shiftable from a first disposition toward a second disposition and returnably shiftable to the first disposition, such shifting acting to port an actuating fluid to stroke an intensifier plunger for compressing fuel in an intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, comprising:

a spill passageway operably disposed in fluid communication with the intensifier pressure chamber, the spill passageway spilling fuel from the pressure chamber for a select duration of time after initiation of the intensifier plunger compressive stroke motion, the spill passageway effecting a selected hydraulic delay between the initiation of an actuation command to the controller and the commencement of fuel injection the spill passageway having a spill port opening into the intensifier pressure chamber, the spill port being open when the intensifier plunger is in a first retracted position.

79. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a spill port intersecting the cylinder wall, the spill port being variably openable and closeable by the intensifier plunger during the translating motion of the intensifier piston for spilling fuel from the variable volume intensifier pressure chamber as desired, the intensifier plunger acting cooperatively with the spill port to delay the beginning of fuel injection with respect to initiation of intensifier plunger valve motion.

80. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a spill port intersecting the cylinder wall, the spill port being variably openable and closeable by the intensifier plunger during the translating motion of the intensifier piston for spilling fuel from the variable volume intensifier pressure chamber as desired, the intensifier plunger acting cooperatively with the spill port to delay the beginning of fuel injection with respect to initiation of actuation of an injector control valve.

81. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a spill port intersecting the cylinder wall, the spill port being variably openable and closeable by the intensifier plunger during the translating motion of the intensifier piston for spilling fuel from the variable volume intensifier pressure chamber as desired, the intensifier plunger acting cooperatively with the spill port to delay the beginning of fuel injection with respect to initiation of actuation of an injector control valve.

82. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a control valve having a spool shiftable between a first position and a second position by magnetic action, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired; and the intensifier plunger acting cooperatively with the spill port to control the beginning of fuel injection.

83. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a control valve having a spool shiftable between a first position and a second position by magnetic action, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired; and the intensifier plunger acting cooperatively with the spill port to delay the beginning of fuel injection with respect to initiation of intensifier plunger valve motion.

84. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a control valve having a spool shiftable between a first position and a second position by magnetic action, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired; and the intensifier plunger acting cooperatively with the spill port to delay the beginning of fuel injection with respect to initiation of actuation of the injector control valve spool.

85. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a control valve having a spool shiftable between a first position and a second position by magnetic action, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired; and the intensifier plunger acting cooperatively with the spill port to delay the beginning of fuel injection with respect to initiation of actuation of the injector control valve spool.

86. A fuel injector having an intensifier plunger, the intensifier plunger being translatable in a cylinder between a retracted position and a full stroke position, the cylinder being defined by a cylinder wall, the cylinder wall defining in part a variable volume intensifier pressure chamber, the pressure chamber being in direct fluid communication with a surface during an injection of fuel, a certain pressure bearing on the surface acting to open an injector needle valve to effect the fuel injection, the intensifier pressure chamber having a fuel inlet port, the fuel injector comprising:

a control valve having a spool shiftable between a first position and a second position by magnetic action, defining a round trip of the valve spool, the round trip being translating motion between the first position and the second position and a returning translating motion to the first position, a spill port intersecting the cylinder wall, the spill port being variably openable and closeable by the intensifier plunger during the translating motion of the intensifier piston for spilling fuel from the variable volume intensifier pressure chamber as desired; and the intensifier plunger acting cooperatively with the spill port to delay the beginning of fuel injection with respect to initiation of actuation of the injector control valve spool.

87. The fuel injector of claim 86 wherein the intensifier plunger acts cooperatively with the spill port to delay the beginning of fuel injection with respect to initiation of actuation of the injector control valve spool for a duration that is at least equal in duration to a time of a minimum round trip of the control valve spool.

* * * * *